United States Patent [19]

Paton et al.

[11] 3,971,430

[45] July 27, 1976

[54] FURNACE FOR ELECTROSLAG REMELTING OF CONSUMABLE ELECTRODES

[76] Inventors: Boris Evgenievich Paton, ulitsa Kotsjubinskoga, 9, kv. 21; Boris Izrailevich Medovar, bulvar Lesi Ukrainki 2, kv. 8; Jury Pavlovich Shtanko, ulitsa E.Potie, 9, kv. 92, all of Kiev; Georgy Emmanuilovich Tsukanov, ulitsa Ryleeve 24/7, kv. 26, Moscow; Alexei Georgievich Bogachenko, ulitsa Muljutenko 15/2, kv. 141, Kiev; Oleg Petrovich Bondarenko, ulitsa Kreschatik 15, kv. 34, Kiev; Viktor Mikhailovich Martyn, ulitsa Vernadskogo 67, kv. 81, Kiev; Vitaly Mikhailovich Baglai, ulitsa Semashko 10, kv. 54/3, Kiev; Leonid Mikhailovich Stupak, Brest-Litovsky prospekt, 39, kv. 9, Kiev; Viktor Leonidovich Artamonov, ulitsa Sovskaya 9, kv. 4, Kiev; Georgy Anatolievich Pavliichuk, ulitsa Erevanskaya 8, kv. 8, Kiev, all of U.S.S.R.

[22] Filed: Apr. 8, 1975

[21] Appl. No.: 551,682

Related U.S. Application Data

[63] Continuation of Ser. No. 233,627, March 10, 1972, abandoned.

[52] U.S. Cl. ..... 164/252

[51] Int. Cl.[2] ..... B22D 27/02

[58] Field of Search ..... 164/52, 252

[56] References Cited

UNITED STATES PATENTS

| | | | |
|---|---|---|---|
| 2,225,415 | 12/1940 | Junghans | 164/85 |
| 3,610,320 | 10/1971 | Medovar | 164/252 |
| 3,683,997 | 8/1972 | Uziie et al. | 164/52 |
| 3,782,445 | 1/1974 | Luchok et al. | 164/52 |

FOREIGN PATENTS OR APPLICATIONS

| | | | |
|---|---|---|---|
| 859,652 | 12/1970 | Canada | 164/52 |

*Primary Examiner*—Ronald J. Shore
*Assistant Examiner*—Gus T. Hampilos
*Attorney, Agent, or Firm*—Holman & Stern

[57] ABSTRACT

A furnace for the electroslag remelting of consumable electrodes in a single mould, having a common slag bath and a zone for shaping simultaneously several ingots separated into parts with the aid of at least one dividing wall.

2 Claims, 5 Drawing Figures

FURNACE FOR ELECTROSLAG REMELTING OF CONSUMABLE ELECTRODES

CROSS-REFERENCE TO RELATED APPLICATION

The present application is a continuation of applicants' copending application Ser. No. 233,627, filed Mar. 10, 1972 and now abandoned.

BACKGROUND OF THE INVENTION

1. Field of the Invention

The present invention relates to electrometallurgy and more particularly to furnaces for the electroslag remelting of consumable electrodes to produce several metal ingots at one and the same time.

2. Description of Prior Art

Commonly known is the use of furnaces for electroslag remelting of consumable electrodes, the furnaces incorporating: an electrode support carrying an electrode holder with one or several consumable electrodes connected to a power supply source, a baseplate for a device (a mould) having an internal space or a cavity for melting the consumable electrodes and forming an ingot, and gears for relative motion among the electrode holder, the mould and the baseplate.

While furnaces are suitable for producing ingots of both round and rectangular cross section (slabs), their capacity, however, cannot meet ever-rising demand for metal ingots.

Attempts have therefore been made to develop a furnace with three stationary moulds operating in parallel, each mould being designed to build-up only one ingot at a time and to remelt at least a single consumable electrode.

Thus, such a prior art furnace has consumable electrodes, and encloses three slag baths which require a substantial power input for heating and for maintaining the requisite temperature of a melt thereupon; however, the simultaneous cooling of the three moulds will lead to loss of the heat.

The consumable electrodes, and there are at least three of them, are placed at a spacing which includes the thickness of walls of neighboring moulds. This in turn will necessitate larger dimensions of both the electrode holder and the furnace and will complicate the servicing operations.

Lack of high-capacity compact furnaces for the electroslag remelting of consumable electrodes to cater the requirements of modern technology poses a problem to tackle which is associated with a number of difficulties.

SUMMARY OF THE INVENTION

The present invention is in essence aimed at developing a furnace for the electroslag remelting of consumable electrodes which furnace ensures a higher capacity, is more efficient in service owing to lower power and coolant requirements and is more convenient from the point of view of maintenance.

Still another object of the invention is to simplify the design of an electrode holder.

No less important an object of the present invention is to reduce furnace dimensions.

The specified and other objects of this invention are achieved by developing a furnace for the electroslag remelting of consumable electrodes with a mould in which a single slag bath would assure simultaneous shaping of several ingots by virtue of which the furnace would be more compact and efficient in operation.

The problem has been solved by designing a furnace for the electroslag remelting of consumable electrodes, the furnace comprising: an electrode support carrying an electrode holder with consumable electrodes connected to a power supply source, a baseplate for a device, e.g., a mould, with a cavity for melting the consumable electrodes and forming simultaneously several ingots, and gears for relative motion among the electrode holder, the device and the baseplate; in the furnace conforming to the present invention, the foregoing device is a mould whose interior is fitted with at least one cooled vertical dividing wall located in an ingot-shaping zone and designed for separating the zone into parts.

Peculiar to the above furnace is a higher production rate as compared to conventional designs, with the inventive furnace being more compact, efficient in service and more convenient in operation.

It would be expedient to employ the mould-dividing wall equal in height preferably to 0.5–2.5 times the diameter or size of the minimum cross-sectional size of the part of the ingot-shaping zone.

The above height is found quite adequate to shape an ingot and to keep the melt from flowing out of the mould.

It is desirable that the width of the mould-dividing wall not exceed the spacing between the internal surfaces of the adjacent consumable electrodes; in such a case, the dividing wall is not subjected to the influence of droplets of liquid metal flowing off the surface of the consumable electrode being flashed.

The top portion of the dividing wall is preferably made to have chamfers forming angles of about 15°–85° with respect to the horizon.

The above shape of the top portion of the dividing wall prevents the consumable electrodes and the wall from short-circuiting when the electrodes are deeply immersed into the slag bath.

Favorable conditions are created when the side length-wise walls of the dividing wall have a 1°–2° recess or nick to a vertical in their middle portion.

This is conducive to the production of ingots with a smooth surface, facilitates ingot transfer at the initial stage of the ingot-shaping process and cooling of the ingot when it emerges from the mould.

Considerably advantageous is the use of a dividing wall made up of dismountable elements either of which has its own connecting piece for individual connection to a coolant source.

With the above arrangement of the dividing wall one and the same mould can be tailored to melt ingots of different cross sections.

BRIEF DESCRIPTION OF THE DRAWINGS

For the purpose of giving those skilled in the art a better understanding of the invention given below is the description of an exemplary embodiment of a furnace for the electroslag remelting of consumable electrodes to be considered with due reference to the appended drawings wherein.

DESCRIPTION OF THE PREFERRED EMBODIMENT

Figure 1:
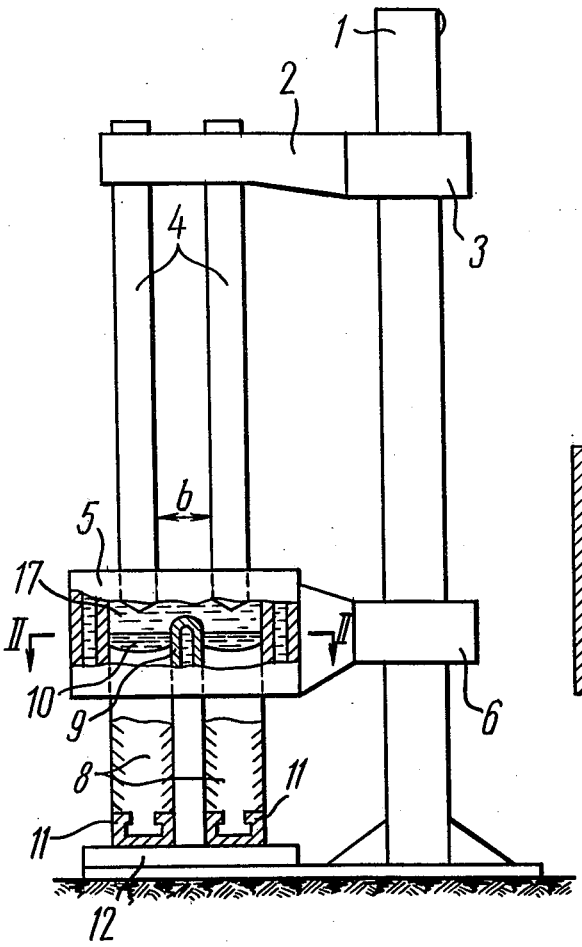
FIG. 1 shows a general cut-away view of a furnace.

According to this invention, a furnace is fitted with an electrode support 1 (FIG. 1) carrying an electrode holder 2 with its vertical travel gear 3 and consumable electrodes 4 connected electrically to a d.c. or a.c. power source (not shown in the drawing).

Figure 2:
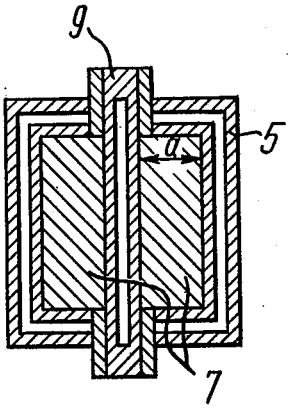
FIG. 2 shows a sectional view taken along line II—II of FIG. 1.

A device with an internal space or a cavity for melting the consumable electrodes 4 is provided in the form of a mould 5 having means 6 for its vertical motion relative to the electrode support 1. In cavity 7 (FIGS. 2 and 3) of the mould 5 in an ingot-shaping zone a water-cooled dividing wall 9 is provided (FIG. 2) separating the above zone into two parts with two metal pools 10 feeding ingots 8.

Dummy-bars 11 rigidly fixed on a stationary baseplate 12 are designed to close the cavity 7 of the mould 5 from below in the initial period of the melting operation; they contribute also to the gripping and withdrawing of the ingots 8 from the mould 5.

The dimensions, configuration of the dividing walls 9 and their number are chosen depending on the requisite shape and size of the ingots and their number.

Preferably, the height of the dividing wall 9 is equal to 0.5–2.5 times the diameter or size of minimum cross-sectional side *a* (FIG. 2) of a part of the ingot-shaping zone at the bottom of the mould.

As for the width of the dividing wall 9 it is preferably equal to or less, but not more than a spacing *b* (FIG. 1) between the internal surfaces of adjacent consumable electrodes 4.

The top portion (edge) of the dividing wall 9 may have chamfers 13 which form angles $\alpha$ of about 16°–85° to the horizon. The side surfaces 14 of the elongated dividing walls 9 preferably have 1°–2° recesses (or nicks) in their middle section. The dividing wall 9 might be of split construction built up of dismountable elements 15 one of which has a connecting piece 16 for individual connection to a coolant source (not shown in the drawing).

This will allow changing the size of various parts of the ingot-shaping zone to obtain ingots 8 of different cross section in one and the same mould 5. The latter encloses slag bath 17 which is common for all ingots being melted.

Conforming to this invention the furnace functions as follows.

Before the electroslag process is started, the dummy-bars 11 are rigidly fixed to the stationary baseplate 12 onto which the mould 5 with the dividing wall 9 is mounted with the aid of the gear 6.

Next, the consumable electrodes 4 secured on the electrode holder 2 are introduced into the cavity 7 of the mould 5. This is performed by means of the gear 3. Then the cavity 7 in the mould 5 is filled with liquid slag forming a common slag bath 17, and voltage is applied across the consumable electrodes 4 and the baseplate 12.

The consumable electrodes 4 start melting down and the ensuing liquid metal flows into the slag bath 17 and on refining is delivered to ingot-shaping zone of the mould 5 on both sides of the dividing wall 9.

The profile of both the top and middle portion of the dividing wall 9 and its size make for separation of the liquid metal into pools 10 in the ingot-shaping zone. As ingots 8 are built-up, the mould 5 together with the dividing wall 9 is displaced in a vertical direction with a speed close to that at which the level of the slag bath 17 goes up.

Suitable cooling of the dividing wall 9 of appropriate height disposed in the ingot-shaping zone prevents any melt leakage from the mould 5 and promotes better shaping of the ingots 8.

Figure 3:
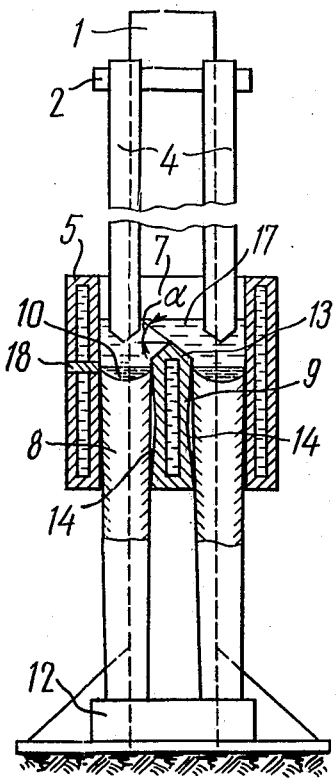
FIG. 3 depicts a side cut-away view of the same furnace having a dividing wall fitted with chamfers in its upper portion and with recesses in the middle portion.
Figure 5:
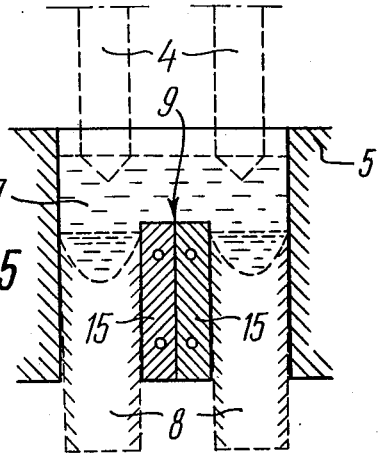
FIG. 5 is a sectional view taken along line V—V of FIG. 4.
Figure 4:
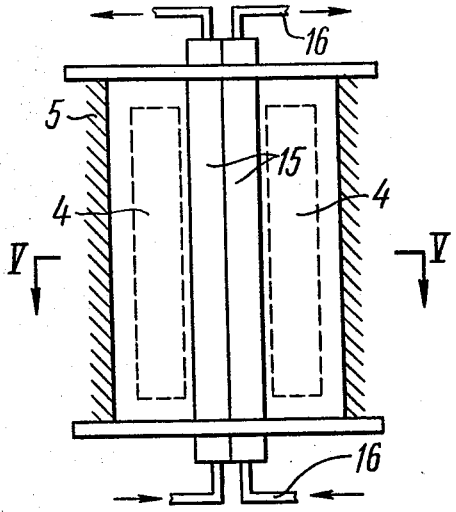
FIG. 4 is a plan view of a mould having a dividing wall made from dismountable elements.

The liquid metal stream running off the surface of the consumable electrodes 4 being flashed may have some adverse effects. Chamfers 13 on the top portion of the dividing wall 9 keep the liquid metal from short-circuiting with the consumable electrodes when immersed deeply in the slag bath 17. A configuration of the side surface of the dividing wall 9 as in FIG. 3 provides for the production of ingots 8 with smooth surface, facilitates ingot transfer at the beginning of the ingot-shaping process and is conducive to their cooling when they emerge from mould 5. A dividing wall 9 produced of dismountable elements 15 makes it possible to design and utilize one and the same mould 5 for melting ingots of various width.

The use of a single mould instead of a conventional three mould plant makes it possible to reduce, conforming to this invention, the dimensions of the furnace and to increase its output and efficiency.

In a modified embodiment of the furnace the mould is fixed rigidly and the ingots are withdrawn from its cavity 7.

In addition, automatic control of the rate of relative motion of the ingots 8 and the mould 5 is possible with the aid of a level detector 18 of the metal pool 10 and a mould travel rate controller (not shown in the drawing).

For supplying gas and/or gas-powder mixtures into the melt, the dividing wall 9 may be provided with passages (not shown in the drawing) leading into the cavity 7 of the mould 5 at the level of the metal pools 10.

What is claimed is:

1. A furnace for the electroslag remelting of consumable electrodes for simultaneously forming at least two ingots, comprising: electrode supporting means including an electrode holder secured thereon and carrying at least two consumable electrodes connected to a power supply source; a mould having a common internal spatial cavity adapted to contain slag and having at least two separate ingot-shaping zones divided by at least one cooled vertical dividing wall; the dividing wall adapted to separate the molten metal in each ingot-shaping zone into separate pools and permit a common slag bath for the zones; the dividing wall is of a split construction made up of dismountable elements at least one of which is provided with a connecting piece for individual connection to a coolant source for cooling the dividing wall; each electrode being positioned over each ingot-shaping zone; a baseplate adapted to close the ingot-shaping zones from below during a first stage of the melting process; means for creating a relative motion between the electrode holder and the mould and the baseplate in a vertical direction; the height of the dividing wall is from 0.5–2.5 times the dimension of a minimum cross-sectional side of the part of the ingot-shaping zone; the width of the dividing wall does not exceed the spacing between the internal surfaces of the two adjacent consumable electrodes; the number of consumable electrodes equals the number of ingot-shaping zones; and the upper edge of the dividing wall is chamfered, forming angles of about 15°–85° to the horizon.

2. The furnace as claimed in claim 1, in which the dividing wall comprises elongated side walls having middle portions which are formed with 1°–2° recesses to a vertical.

* * * * *